US006319078B1

(12) United States Patent
Thörner

(10) Patent No.: US 6,319,078 B1
(45) Date of Patent: Nov. 20, 2001

(54) CABLE LUG

(76) Inventor: Wolfgang B. Thörner, Hatzper Strasse 125, D-45149 Essen (DE)

( * ) Notice: Subject to any disclaimer, the term of this patent is extended or adjusted under 35 U.S.C. 154(b) by 0 days.

(21) Appl. No.: 09/647,035

(22) PCT Filed: Mar. 26, 1999

(86) PCT No.: PCT/EP99/02090

§ 371 Date: Nov. 8, 2000

§ 102(e) Date: Nov. 8, 2000

(87) PCT Pub. No.: WO99/49537

PCT Pub. Date: Sep. 30, 1999

(30) Foreign Application Priority Data

Mar. 26, 1998 (DE) ..... 198 13 370

(51) Int. Cl.[7] ..... H01R 11/11
(52) U.S. Cl. ..... 439/883
(58) Field of Search ..... 439/883, 382, 439/868, 877, 781, 790, 791, 801

(56) References Cited

U.S. PATENT DOCUMENTS 4,136,924 * 1/1979 Dobrosielski et al. ..... 439/883
5,108,320 4/1992 Kimber ..... 439/883
5,188,544 * 2/1993 Mukai ..... 439/777
5,413,500 * 5/1995 Tanaka ..... 439/521
5,533,913 7/1996 Boehm et al. ..... 439/810

FOREIGN PATENT DOCUMENTS 79 13 505 8/1979 (DE) .

* cited by examiner

*Primary Examiner*—Tulsidas Patel
(74) *Attorney, Agent, or Firm*—Collard & Roe, P.C.

(57) ABSTRACT

The invention relates to a cable lug for connecting a cable end to a screw type terminal. The cable lug comprises a flat, u-shaped contact fork which is open toward the front and which merges into a fork shaft toward the rear. The fork shaft is provided with connection means for a cable end. At least one base plate configured as a signal conductor, at least one damping disk made of elastic material, and at least one cover plate are assembled in a stacked, sandwich-like manner in the area of the contact fork. In order to improve functional characteristics and durability, and more particularly to obtain an improved vibration-damping action, the invention provides that the cover plate extends over the sides of the damping disk.

12 Claims, 3 Drawing Sheets

CABLE LUG

CROSS-REFERENCE TO RELATED APPLICATIONS:

Applicants claim priority under 35 U.S.C. §119 of German Application No. 198 13 370.7 filed Mar. 26, 1998. Applicants also claim priority under 35 U.S.C. §120 of PCT/EP99/02090 filed Mar. 26, 1999. The international application under PCT article 21(2) was not published in English.

BACKGROUND OF THE INVENTION

1. Field of the Invention

The invention relates to a cable lug for connecting the end of a cable to a screw-type terminal, with a flat U-shaped contact fork that is open toward the front and merges into a fork shaft toward the rear, said fork shaft being provided with connecting means for the connection to a cable end, whereby at least one base plate configured as a signal conductor, and at least one damping disk made of elastic material with at least one cover plate, are assembled in a stacked, sandwich-like manner within the area of the contact fork.

2. The Prior Art

Such cable lugs are preferably employed as connection elements for electrical high-current connections for connecting the ends of cables to screw bolt-type connectors, the latter being referred to as screw or connection terminals. Such terminals are substantially formed by a threaded bolt that projects vertically from a contact surface, whereby a nut or another type of terminal element with a female thread can be screwed to the free end of said threaded bolt. For connecting the cable lug to such a terminal, the contact fork is first pushed into an axial gap between the contact surface and the nut and then radially onto the screw bolt, and the nut is subsequently tightened, so that the contact fork is axially solidly clamped between the nut and the contact surface of the terminal.

Due to the relatively large contact surfaces in the U-shaped zone of the contact fork, the transition resistance to the corresponding contact surfaces on the terminal is accordingly low. Such cable lugs are therefore frequently used for connecting loudspeaker cables with large conductor cross sections with high-load capacity, to the output terminals of amplifier output stages.

However, it has already been found that forming the contact fork from a simple sheet metal tab or plate is inadequate for such applications. Even if such a contact fork is solidly tightened by hand, it is possible that the contact fork is excited to mechanical vibrations by the sound frequency signals, which are transmitted with high current intensities, by magnetostriction, and also by body and air sound. Such vibrations lead to relative movements of the contact surfaces stacked one on top of the other, which is directly reflected by signal interferences. Such interferences are, of course, absolutely undesirable especially when connecting high-quality sound transformers to amplifier output stages.

In order to deal with the problems mentioned above, is has already been proposed in the prior art disclosed by U.S. Pat. No. 5,108,320, to realize the contact fork within the zone of the contact surfaces in the form of a sandwich-like construction comprising a base plate, an elastomer disk, as well as a cover plate. The base plate and the cover plate are realized in this connection as metal sheet forks congruently disposed on top of the other, with an also U-shaped rubber disk being clamped or glued in between said sheet metal forks within the zone of the U-shaped contact surfaces.

The contact surfaces clamped together in the connection terminal are elastically pressed against each other by the inherently elastic rubber or elastomer disk. The elastic initial clamping assures that the contact surfaces are pressed against each other in an elastic manner, which enhances the electrical transfer.

However, a basic problem in connection with the known cable lug lies in fixing the elastomer disk between the base plate and the cover plate in such a way that its optimal function is assured under all operating conditions, because it is necessary for such fixation that both shifting of the elastomer disk as a whole and any lateral squeezing out of the latter is effectively avoided when it is pressed axially. Gluing the disk to the cover or base plate would be considerably stressed by elastic deformations. Furthermore, the rubber would continue to swell out from between the cover and the base plates sideways, and the rubber material may be damaged by the wedge effect caused on the edges.

Furthermore, in connection with the known cable lugs, the elastomer disk is subjected to the risk that it may be crushed by the forces of pressure occurring in the terminal during clamping when the clamping nuts are tightened.

Finally, an added problem is that in the prior art, the elastomer disk is exclusively loaded spring-elastically in the axial direction, which means that it is possible that mechanical resonances may occur as a result of the undamped spring effect of the rubber material. This causes the contact surfaces of the contact fork and of the screw-type terminal to vibrate against each other without practically any damping.

SUMMARY OF THE INVENTION

In view of said problems the present invention is based on the problem of further developing a cable lug based on the prior art specified above in such a way that the functional properties as well as the durability are improved. In particular, the aim is to achieve enhanced damping of vibrations as well as protection of the elastomer disk against damage as it is being clamped tight.

For solving said problem the invention proposes on the basis of the prior art specified above that the cover plate extends over the sides of the damping disk.

The design of the cover plate as defined by the invention provides that said cover plate has bends, bridges or reinforcements projecting in the direction of the base plate and continuously or by sections extending along the outer edge in the front zone of the U-shaped contact. The elastomer disk is framed in this way along its side edges.

The embodiment as defined by the invention ensues the basic advantage that any lateral movement of the damping disk beyond the edge of the cover plate is prevented without requiring any gluing or the like. Due to the embodiment as defined by the invention, the damping disk is enclosed by the cover plate in the way of a frame, so that it cannot migrate sideways beyond the edge of the cover plate. Furthermore, it is protected also against being squeezed out sideways in any uncontrolled manner as it is being clamped in the connection terminal.

In view of the vibration-damping properties it is particularly advantageous that the damping disk is now additionally supported laterally. When the contact fork is pressed together, not only an initial spring tension acts on the elastically deformable material of the damping disk in the pressing direction, but a hydraulic load is additionally acting in the areas enclosed laterally and at the top by the cover plate as well, whereby both the inner friction of the hydraulically stressed elastic materials and particularly also the interface friction between the damping disk and the lateral areas of the cover plate provide for a substantially increased damping effect with respect to relative movements between the cover plate and the base plate. The tendency to vibration is reduced accordingly, which, of course, is to the benefit particularly of any application in areas that are sensitive in that regard, for example to a connection of high-performance loudspeakers to output stages.

According to a particularly advantageous further development of the invention, provision is made that the cover plate has a side wall projecting downwards and extending all around its outer contour at least in the zone of the contact fork, said side wall laterally extending over the damping disk up to the base plate in the way of a box. The cover plate deeply drawn downwards on the sides practically forms a box or case that is closed on the sides and on top, and against which the damping disk is resting. The space enclosed in the box or base can be covered from the bottom by the base plate, i.e. it can be locked. In order to achieve this, the side wall, in its unstressed resting condition, may reach down up to the top edge of the base plate except for a small gap. Said gap is closed when the base plate and the cover plate are pressed together during clamping, whereby the box or case is closed at the same time.

According to another particularly advantageous further development of the invention, provision is made that the base plate can be immersed like a piston in the space that is defined laterally and at the top by the cover plate. In the present embodiment, the box or case formed by the cover plate may extend over the top edge of the base plate as well. Thus the base plate is forming a piston- or punch-like element which, when the contact fork is pressed together, acts upon the damping disk that is now enclosed on all sides in the box. The principle of a hydraulic shock absorber is practically realized in this way, whereby the enclosed damping disk assumes the function of the hydraulic damping medium. As it is known, for example from shock absorbers for motor vehicles or the like, a particularly high damping effect is achieved with respect to mechanical vibrations by means of hydraulic, hydro-mechanical or hydro-pneumatic friction effects. Undesirable contact vibrations, regardless of whether they are caused by sound or magneto- or electrostriction, are practically completely suppressed, which, of course, is a benefit especially to signal transmission in high-end equipment of entertainment electronics.

The piston-like embodiment of the base plate can be advantageously realized by providing it in the zone of the contact fork with a step at the top edge, providing it thereby with a T-shaped cross section lying upside down. Said cross section can immerse in the box or case formed by the cover plate to such an extent until the edge of the side wall abuts the horizontal surface of the step. A defined end stop is formed in this way, and crushing is prevented.

The cover plate itself preferably consists of spring-elastic material and is permanently joined with the shaft of the fork behind the U-shaped contact surfaces. The elastomer disk is then elastically clamped between the cover plate and the base plate.

The cover plate preferably consists of hardened, heat-treated steel sheet material, for example V4A. Owing to its hardness and spring elasticity, said material has adequate dimensional stability in order to absorb the pressure forces occurring when the elastomer disk is hydraulically clamped. Furthermore, the surface is largely insensitive to scratches or other damage caused when the connection is made to a terminal. The cover plate, furthermore, is preferably manufactured by deep-drawing a one-piece sheet cut, which is subsequently hardened.

Is useful, moreover, if the base plate and the fork shaft joined with the latter in the form of one piece consist of highly conductive material. Preferably high-purity, low-oxygen electrolyte copper or also silver are used for the signal conductor. The base plate and/or the cover plate are hard-plated with gold.

The cover plate usefully has stop elements that are movable against the damping disk. Such stop elements are projecting spacers that limit the movement of the cover plate against the base plate, so that the damping disk cannot be crushed accidentally.

The damping disk can basically consist of any desired elastomer materials, for example such a rubber or suitable plastics. Any desired mechanical properties and thus the damping effect can be preset by adjusting the Shore hardness accordingly. Preferably selected in this connection is an elastic material with high inner damping.

The damping effect can be influenced in an advantageous way if the cover plate and/or the damping disk and/or the base plate have hydraulic compensation cavities for the elastic material of the damping disk. For example, molded depressions that are open toward the interior of the case, or also through-extending openings may be provided in the cover plate or the base plate as hydraulic compensation cavities. The material of the damping disk can then be hydraulically displaced into such molded depressions or openings as it is being pressed compressed. In this way, the friction values and thus the damping effect can be optimally adapted to the given requirements. It is also possible, furthermore, to make provision for chambers or molded depressions in the damping disk that serve as compensation cavities. For example, the use of porous rubber materials is conceivable, or also the introduction of cavities in otherwise incompressible materials, with which the hydraulic or hydro-pneumatic damping effect can be preset in a defined manner.

Also, the elastomer material may be directly applied to the cover plate by spray application, if need be.

According to another particularly further development of the invention, provision is made that the damping disk and the cover plate are formed from elastic material in the form of one single piece. By selecting the material or materials and/or through the selected shape, for example by providing for hydraulic compensation cavities, different functional areas are formed in the body comprising the damping disk/cover plate. Such functional areas relate to the function of the cover plate as defined by the invention, on the one hand, and to the damping function on the other.

If the cover plate is combined with the damping disk in the form of one single piece, the functional areas mentioned above can be formed in an advantageous way from materials with different properties that are then joined with one another in the form of one single piece. It is possible, for example, to first produce the cover plate in the form of an injection-molded plastic part made of a material with greater hardness or rigidity, and to subsequently attach the softer damping disk to said cover plate, preferably by injection molding as well, so as to form one single part. The yielding property of said damping disk can be adjusted by using a softer plastic or also through the shape it is provided with, for example through compensation cavities, or foam-like porous areas or the like.

The damping disk is fixed in a particularly safe manner by form-locked elements of the cover plate that engage the damping disk, for example punched tabs or the like.

The contact fork is usefully embedded outside of the contact surfaces in insulating material, for example in plastic injected around it. This is advantageous in view of the easy handling.

The connecting means on the shaft of the fork may have screw clamps for receiving the end of a cable, or, as an alternative, such means may be provided with crimp connectors, i.e. clamping elements that can be squeezed.

So as to assure that the cover plate extends in the zone of the contact surfaces at a spacing parallel with the base plate, it may be provided with a support element resting on the shaft of the fork. The height of such a support element, which, for example, may be formed by bends, is dimensioned depending on the thickness of the elastomer disk. It is assured in this way that the cover plate and the base plate will remain positioned largely parallel with each other after they have been clamped in.

It is advantageous for the assembly that the cover plate is fixed in its position on the fork shaft on laterally protruding locking prongs of the base plate. An association of the cover plate and the base plate is obtained in this way that it clearly correct with respect to the positions of said plates.

BRIEF DESCRIPTION OF THE DRAWINGS

Accordingly, while only a few embodiments of the present invention have been shown and described, it is obvious that many changes and modifications may be made thereunto without departing from the spirit and scope of the invention.

FIG. 1 shows a perspective view of a cable lug as defined by the invention viewed inclined from the top and denoted as a whole by the reference numeral 1. Said cable lug has a U-shaped contact fork 2, which is open toward the front, and which changes into a fork shaft 3 toward the rear, said shaft of the fork being embedded in an insulating and handle body 4 made of plastic.

For the connection to the end of a cable, the fork shaft 3 is provided in its rear zone with the connecting means 5 which, however, are hidden in the present representation by the insulating body 4 except for the heads of the clamping screws. Said clamping screws are screw clamps whose connection opening for connecting the end of a cable is located at the rear end of the insulating body 4.

Figure 1:
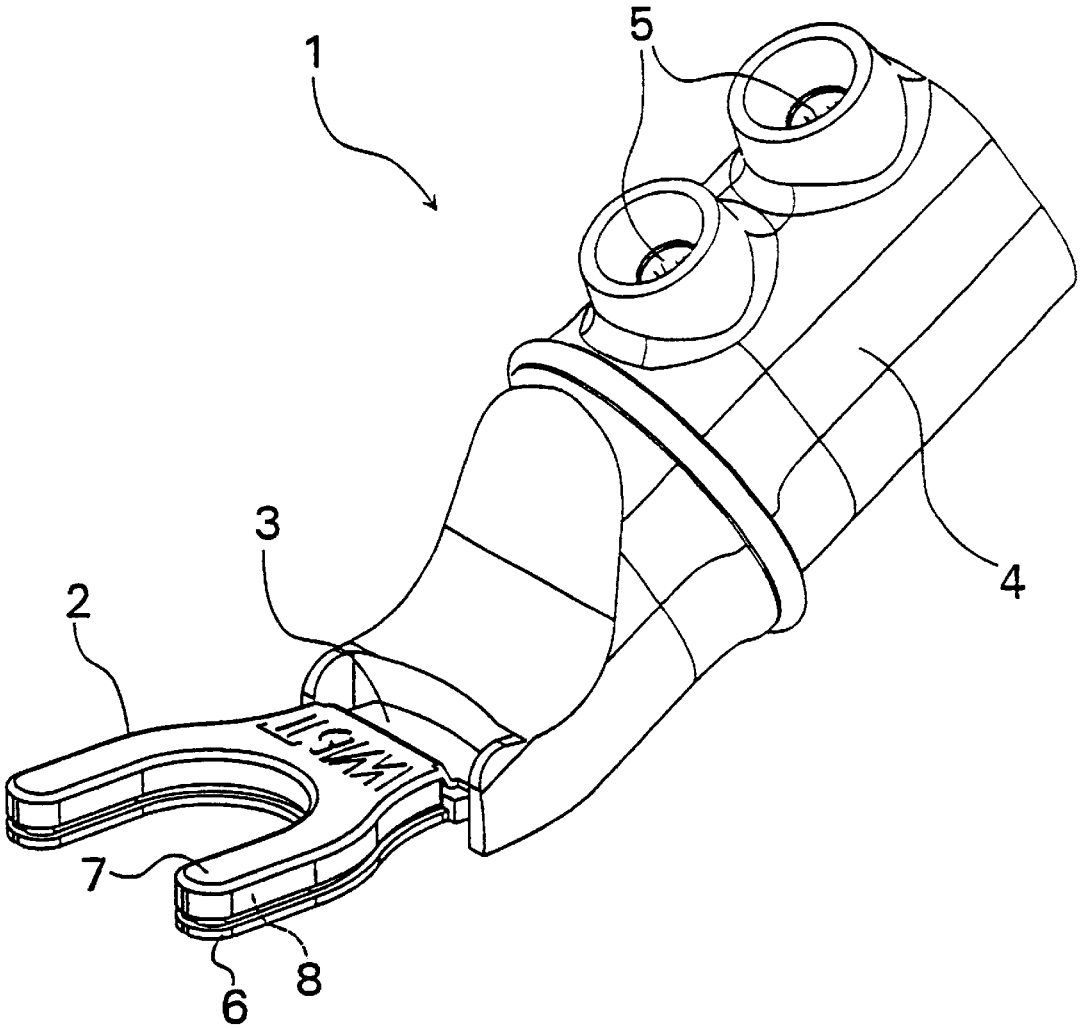
FIG. 1 shows a perspective view of a cable lug as defined by the invention.
Figure 2:
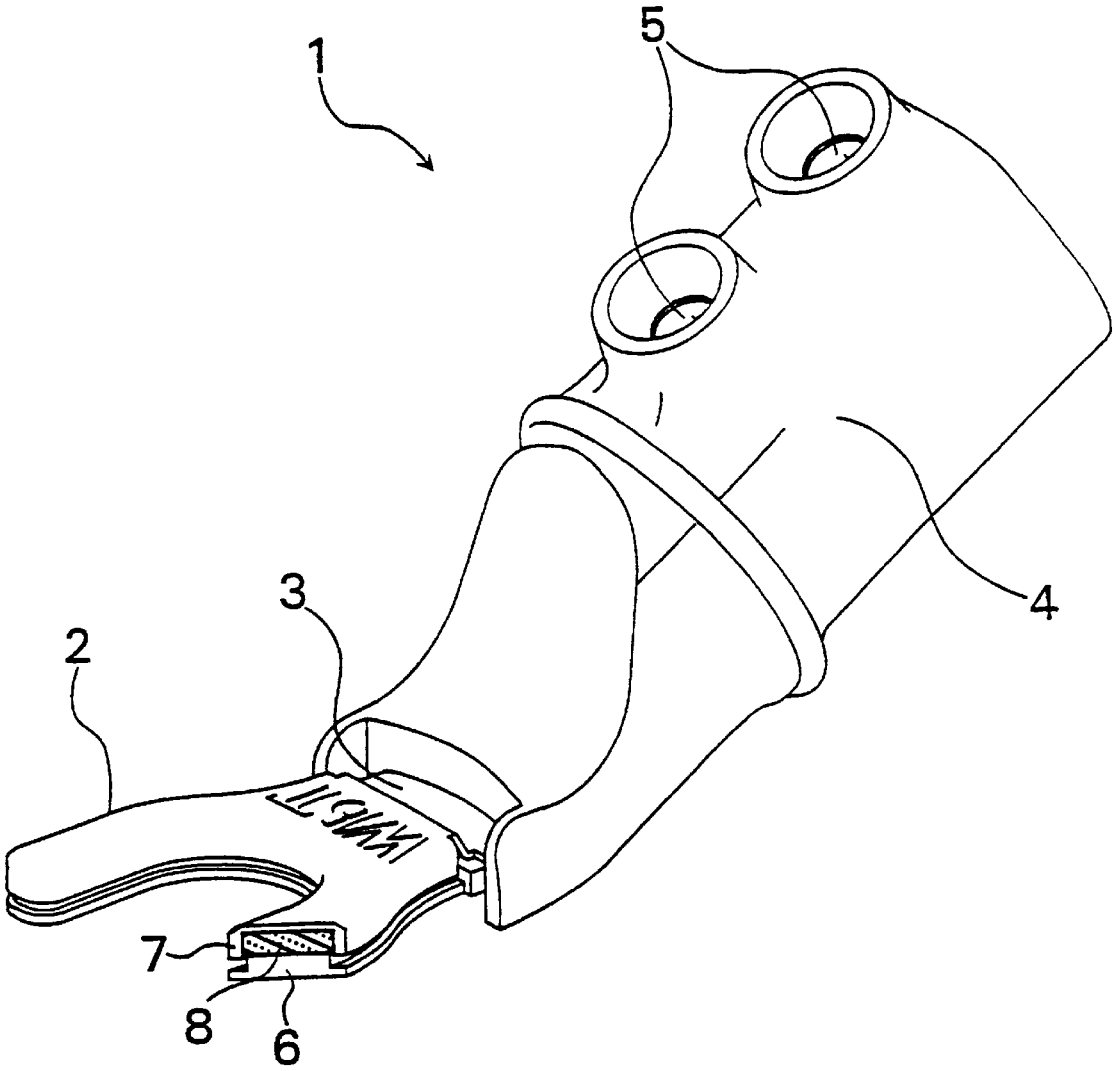
FIG. 2 shows a cable lug according to FIG. 1 by a representation that is partly cut open.

It is already shown by said representation that the contact fork 2 is formed by a U-shaped base plate 6 forming the signal conductor, and a cover plate 7 arranged above said base plate in a stacked, sandwich-like assembly, and having the form of an also U-shaped, downwardly open box or case, with a damping disk 8 made of elastic material, for example rubber being enclosed between said base and cover plates. While the damping disk boxed-in in said manner is not visible in FIG. 1, and only indicated for said reason by dashed lines, the arrangement is particularly clearly shown in FIG. 2. In FIG. 2, the part of the contact fork 2 that is disposed in front in said representation, is shown cut open in a slanted way. The same reference numerals are used.

The base plate 6, which is connected via the fork shaft 3 with the connecting means 5, forming one single piece jointly with said base plate, consists of highly conductive material, for example high-purity copper, or also silver. The cover plate 7 is a heat-treated and hardened, deep-drawn stain steel component and, like the base plate 6, is preferably hard-plated with gold. As an alternative, the cover plate 7 may also consist of another, harder material that is resistant in relation to the damping disk 8, for example plastic. Within the zone of the fork shaft 3, the cover plate 7 is permanently joined with said fork shaft, so that within the zone of the contact fork 2 it is practically movable vertically, i.e. in the axial direction against the base plate 6.

Figure 3:
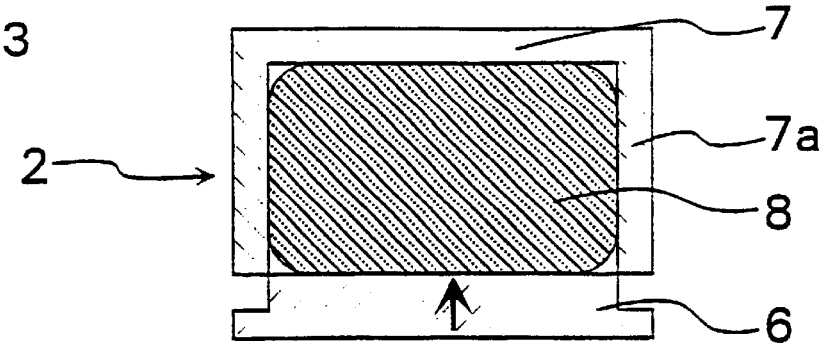
FIG. 3 shows a cross section through a contact fork as defined by the invention.

The cross section through the contact fork according to FIG. 2 is schematically shown again enlarged in FIG. 3. The latter clearly shows how the cover plate 7, whose side walls 7*a* are drawn downwards up to the top edge of the base plate 6, is forming a closed box for the damping disk B. The base plate 6 may in this connection have a T-shaped stepped cross section that can be immersed like a piston in the direction of the arrow up to the edge of the step in the box formed by the cover plate 7 up to the edge of the step.

Figure 4:
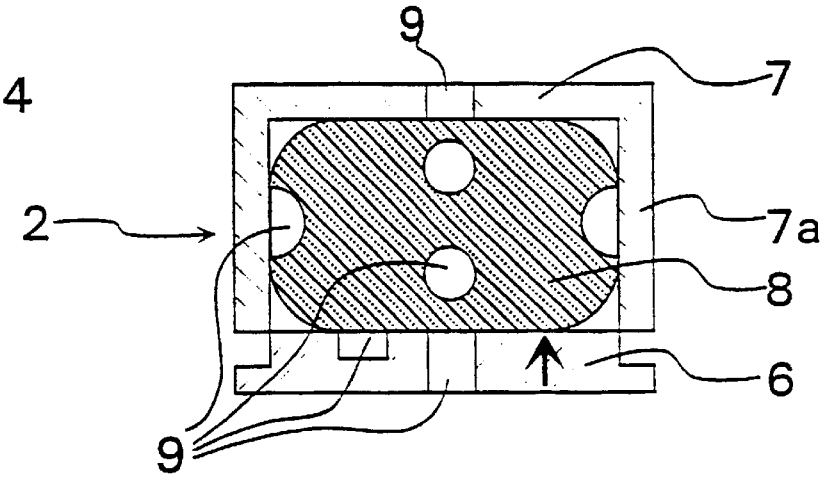
FIG. 4 shows a cross section through a second embodiment of the contact fork as defined by the invention.

The special feature of the embodiment shown in FIG. 4 consists in that both the cover plate 7 and the base plate 8 are provided with the hydraulic compensation cavities 9, which are partly realized in the form of molded depressions and partly as through-expending openings. The damping disk 8 is provided with such compensation cavities 9 as well, which are partly realized in the form of open molded depressions and partly in the form of closed chambers. The elastomer material may be realized in this sense as a whole in the form of a porous material as well.

Figure 5:
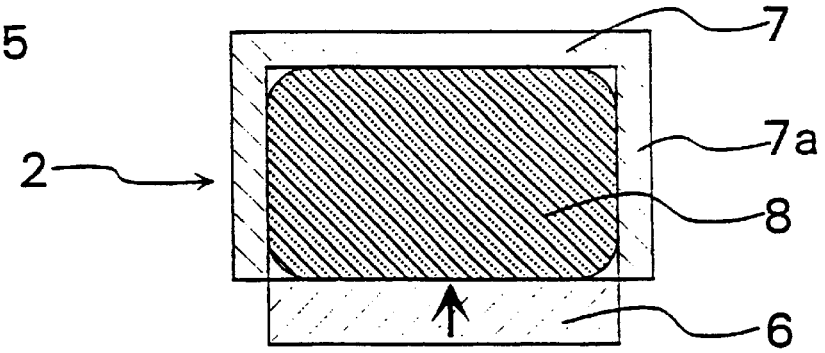
FIG. 5 shows a cross section through a third embodiment of a contact fork as defined by the invention.

FIG. 5 shows a similar embodiment, where the base plate 6 has a non-stepped cross section.

Figure 6:
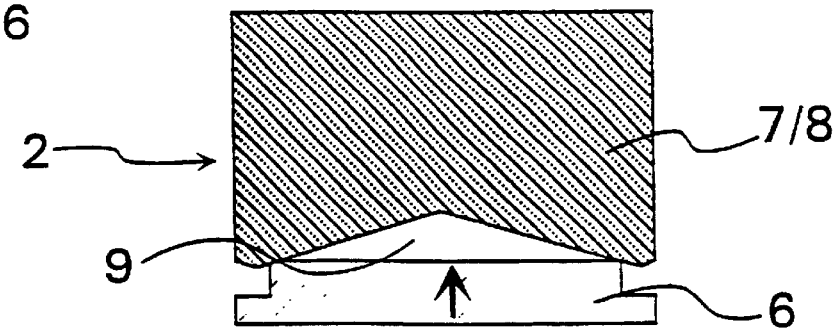
FIG. 6 shows a cross section through a fourth embodiment of a contact fork as defined by the invention.

With the contact fork 2 according to FIG. 6, the cover plate 7 and the damping disk 8 are combined to form a one-piece cover plate/damping disk element 7/8. The inner zone with the hydraulic compensation cavity 9 has in this connection substantially the damping function, whereas the outer zone assumes the cover plate function.

In the embodiments according to the representations in FIGS. 1 to 5, the cover plate 7 may accordingly also consist of a harder plastic material or the like, with which the softer material of the damping disk 8 is joined, forming one single piece. Such a single piece is manufactured, for example by two-component injection molding.

All embodiments of the cable lug 1 as defined by the invention have in common that vibrations of the base plate 6 and the cover plate 7 against each other due to the damping effect of the enclosed damping disk 8 are effectively suppressed, because when the base plate 6 and the cover plate 8 are pressed together, the damping disk 8 consisting of elastomer material is quasi-hydraulically deformed. The hydraulic, hydro-mechanical and hydro-pneumatic friction occurring during such compression entails effective damping. Such effective damping can be adjusted within wide limits by the arrangement of the hydraulic compensation cavities 9, into which the material of the damping disk 8 can flow as it is being compressed, as well as by the hardness selected for the elastic material.

What is claimed is:

1. A cable lug for connecting an end of a cable to a screw-type terminal, comprising a flat contact fork which is open in the form of a "U" toward a front end, and which changes into a fork shaft toward a rear end, said fork shaft comprising a connecting means for connecting the end of the cable, at least one base plate configured as a signal conductor, at least one damping disk made of elastically deformable material, and at least one cover plate are stacked within the area of the contact fork, wherein the cover plate (7) extends over the sides of the damping disk (8).

2. The cable lug according to claim 1, wherein within the area of the contact fork (2) the cover plate (7) has a downwardly projecting side wall **(7*a*) extending all around along its outer contour and reaching over the damping disk (8) up to the base plate (6)**.

3. The cable lug according to claim 2, wherein the base plate (6) comprises a piston, immersible from below in the space limited laterally and at the top by the cover plate (7).

4. The cable lug according to claim 2, wherein within the area of the contact fork (2), the base plate (6) is provided with a step along the upper edge.

5. The cable lug according to claim 1, wherein the cover plate (7) comprises a spring-elastic material and is permanently joined with the fork shaft (3) behind the U-shaped contact surfaces.

6. The cable lug according to claim 1, wherein the cover plate (7) comprises a hardened, heat-treated steel sheet material.

7. The cable lug according to claim 1, wherein the cover plate (7) comprises plastic.

8. The cable lug according to claim 1, wherein the cover plate (7) further comprises stop elements being supportable against the base plate (6).

9. The cable lug according to claim 1, wherein the damping disk (8) comprises elastomer material.

10. The cable lug according to claim 1, wherein one of the following cover plate (7) and the damping disk (8) and the base plate (6) have hydraulic compensation cavities (9) for the elastic material of the damping disk (8).

11. The cable lug according to claim 1, wherein the cover plate (7) has form-locked elements engaging the damping disk (8).

12. The cable lug according to claim 1, wherein the base plate (6) and the fork shaft (3) forming one single piece comprise highly conductive material.

* * * * *